US005829502A

United States Patent [19]

Distefano et al.

[11] Patent Number: 5,829,502

[45] Date of Patent: Nov. 3, 1998

[54] ORGANIZER HANDBAG

[76] Inventors: Sylvia Ruth Distefano; Dominic Distefano, both of 9778 Gene Buckel St., Denham Springs, La. 70726

[21] Appl. No.: 816,512

[22] Filed: Mar. 13, 1997

[51] Int. Cl.[6] ..... A45C 1/02; A45C 3/06

[52] U.S. Cl. ..... 150/113; 150/117; 190/110; 190/111

[58] Field of Search ..... 150/106, 112, 150/113, 111, 119, 150, 104; 190/109–111, 901

[56] References Cited

U.S. PATENT DOCUMENTS

| | | | |
|---|---|---|---|
| 979,763 | 12/1910 | Hollis | 150/112 |
| 1,681,269 | 8/1928 | Tueckmantel | 190/110 |
| 1,705,149 | 3/1929 | Brady | 190/901 X |
| 1,742,656 | 1/1930 | Laprade | 190/110 X |
| 2,361,716 | 10/1944 | Swanson | 150/150 X |
| 2,646,833 | 7/1953 | Meyers | 150/112 |
| 4,444,418 | 4/1984 | Goldstein | 190/901 X |
| 4,569,082 | 2/1986 | Ainsworth et al. | 150/113 X |
| 4,609,084 | 9/1986 | Thomas | 190/111 X |
| 4,852,293 | 8/1989 | Levine et al. | 190/110 X |
| 4,854,432 | 8/1989 | Carpenter et al. | 190/110 |
| 4,887,751 | 12/1989 | Lehman | 190/110 X |
| 4,960,204 | 10/1990 | Young et al. | 190/109 X |
| 5,048,582 | 9/1991 | Whitfield | 190/109 X |
| 5,096,030 | 3/1992 | Espinosa et al. | 190/901 X |

FOREIGN PATENT DOCUMENTS

| | | | |
|---|---|---|---|
| 848242 | 7/1939 | France | 150/106 |
| 433617 | 9/1967 | Sweden | 190/198 |
| 1729441 | 4/1992 | U.S.S.R. | 190/110 |

*Primary Examiner*—Sue A. Weaver

[57] ABSTRACT

A new organizer handbag is provided for organizing items stored therein and providing quick and easy access to such items. The inventive device includes a first-half member and a second-half member hingedly coupled along adjacent bottom edges and releasably joined along adjacent perimeter edges so as to cooperatively define a primary storage compartment. The first-half member and the second-half member are cooperatively and hingedly openable between a closed, generally upright position and an open, generally flat position. A plurality of internal storage compartments adapted for holding small items are provided on the inner surfaces of the first-half member and the second-half member whereby quick and easy access to small items stored within the plurality of internal storage compartments is possible. An inner pouch is contained within the primary storage compartment and is removable for convenient carrying thereof.

5 Claims, 3 Drawing Sheets

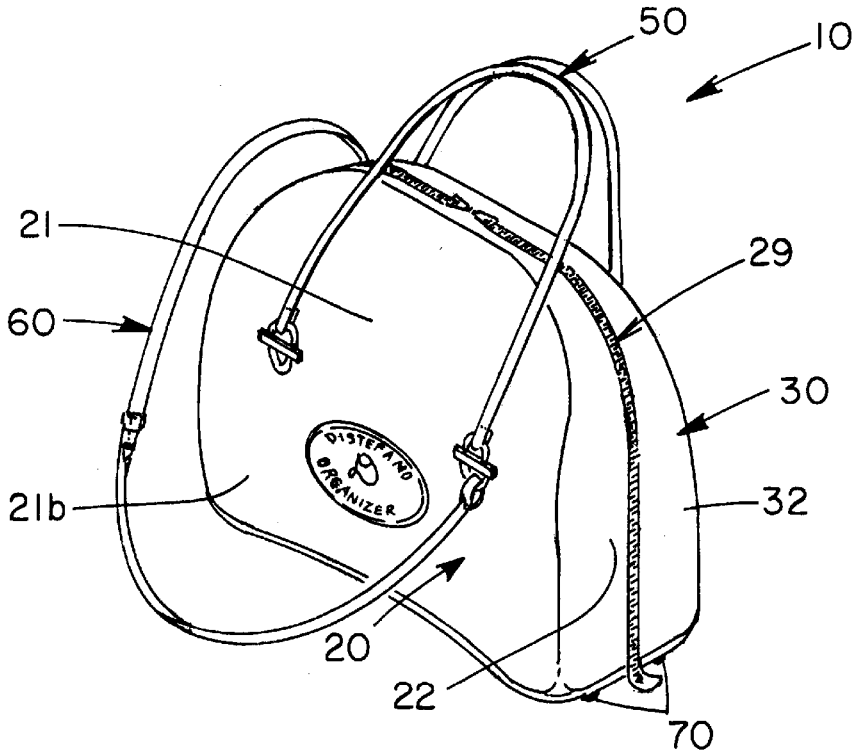
FIG. 1
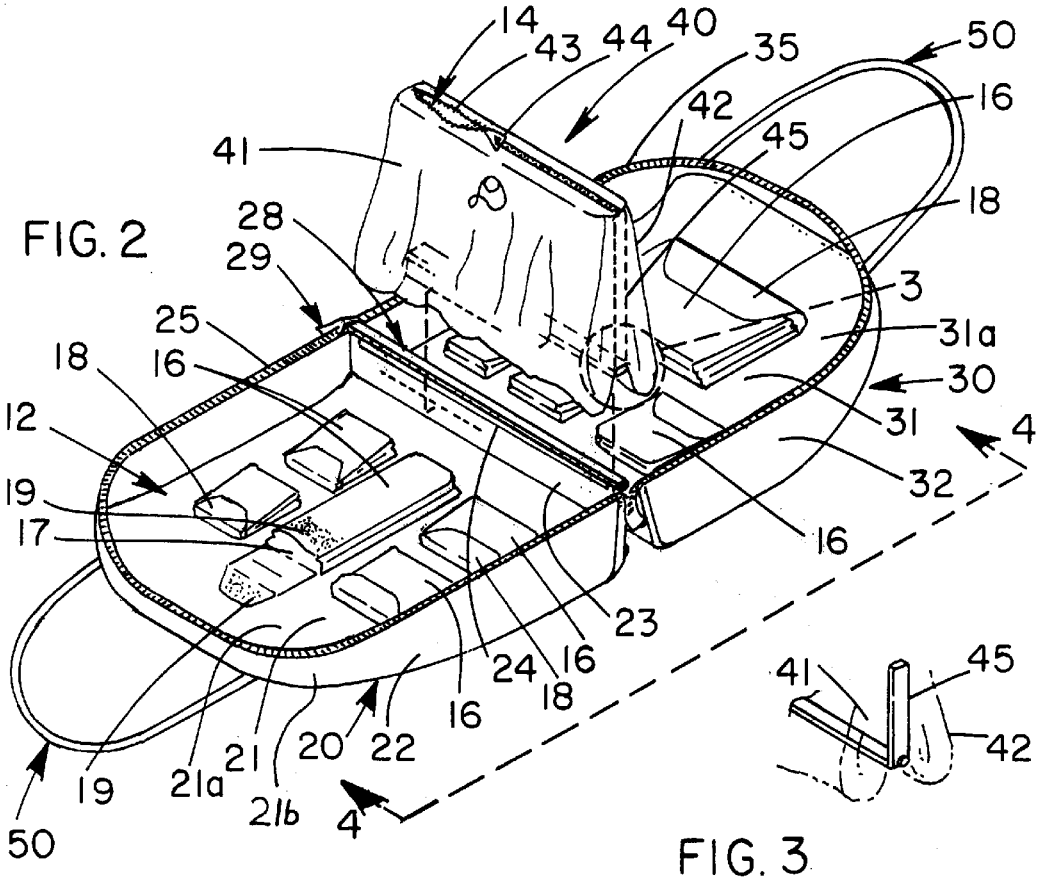
FIG. 2
FIG. 3

ORGANIZER HANDBAG

BACKGROUND OF THE INVENTION

1. Field of the Invention

The present invention relates to handbags and more particularly pertains to a new organizer handbag for organizing items stored therein and providing quick and easy access to such items.

2. Description of the Prior Art

The use of handbags is known in the prior art. More specifically, handbags heretofore devised and utilized are known to consist basically of familiar, expected and obvious structural configurations, notwithstanding the myriad of designs encompassed by the crowded prior art which have been developed for the fulfillment of countless objectives and requirements.

Known prior art handbags include U.S. Pat. No. 5,048,582; U.S. Pat. No. 4,532,972; U.S. Pat. No. D279,428; U.S. Pat. No. 4,250,938; U.S. Pat. No. 4,098,312; and U.S. Pat. No. 4,739,809.

While these devices fulfill their respective, particular objectives and requirements, the aforementioned patents do not disclose a new organizer handbag. The inventive device includes a first-half member and a second-half member hingedly coupled along adjacent bottom edges and releasably joined along adjacent perimeter edges so as to cooperatively define a primary storage compartment. The first-half member and the second-half member are cooperatively and hingedly openable between a closed, generally upright position and an open, generally flat position. A plurality of internal storage compartments adapted for holding small items are provided on the inner surfaces of the first-half member and the second-half member whereby quick and easy access to small items stored within the plurality of internal storage compartments is possible. An inner pouch is contained within the primary storage compartment and is removable for convenient carrying thereof.

In these respects, the organizer handbag according to the present invention substantially departs from the conventional concepts and designs of the prior art, and in so doing provides an apparatus primarily developed for the purpose of organizing items stored therein and providing quick and easy access to such items.

SUMMARY OF THE INVENTION

In view of the foregoing disadvantages inherent in the known types of handbags now present in the prior art, the present invention provides a new organizer handbag construction wherein the same can be utilized for organizing items stored therein and providing quick and easy access to such items.

The general purpose of the present invention, which will be described subsequently in greater detail, is to provide a new organizer handbag apparatus and method which has many of the advantages of the handbags mentioned heretofore and many novel features that result in a new organizer handbag which is not anticipated, rendered obvious, suggested, or even implied by any of the prior art handbags, either alone or in any combination thereof.

To attain this, the present invention generally comprises a first-half member and a second-half member hingedly coupled along adjacent bottom edges and releasably joined along adjacent perimeter edges so as to cooperatively define a primary storage compartment. The first-half member and the second-half member are cooperatively and hingedly openable between a closed, generally upright position and an open, generally flat position. A plurality of internal storage compartments adapted for holding small items are provided on the inner surfaces of the first-half member and the second-half member whereby quick and easy access to small items stored within the plurality of internal storage compartments is possible. An inner pouch is contained within the primary storage compartment and is removable for convenient carrying thereof.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new organizer handbag apparatus and method which has many of the advantages of the handbags mentioned heretofore and many novel features that result in a new organizer handbag which is not anticipated, rendered obvious, suggested, or even implied by any of the prior art handbags, either alone or in any combination thereof.

It is another object of the present invention to provide a new organizer handbag which may be easily and efficiently manufactured and marketed.

It is a further object of the present invention to provide a new organizer handbag which is of a durable and reliable construction.

An even further object of the present invention is to provide a new organizer handbag which is susceptible of a low cost of manufacture with regard to both materials and labor, and which accordingly is then susceptible of low prices of sale to the consuming public, thereby making such organizer handbag economically available to the buying public.

Still yet another object of the present invention is to provide a new organizer handbag which provides in the apparatuses and methods of the prior art some of the advantages thereof, while simultaneously overcoming some of the disadvantages normally associated therewith.

Still another object of the present invention is to provide a new organizer handbag for organizing items stored therein and providing quick and easy access to such items.

Yet another object of the present invention is to provide a new organizer handbag which includes a first-half member and a second-half member hingedly coupled along adjacent bottom edges and releasably joined along adjacent perimeter edges so as to cooperatively define a primary storage compartment. The first-half member and the second-half member are cooperatively and hingedly openable between a closed, generally upright position and an open, generally flat position. A plurality of internal storage compartments adapted for holding small items are provided on the inner surfaces of the first-half member and the second-half member whereby quick and easy access to small items stored within the plurality of internal storage compartments is possible. An inner pouch is contained within the primary storage compartment and is removable for convenient carrying thereof.

Still yet another object of the present invention is to provide a new organizer handbag that provides a user of the handbag with the comforting peace of mind of knowing the exact location of items stored therein.

Even still another object of the present invention is to provide a new organizer handbag that enables a user of the handbag to quickly and easily locate items stored therein.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is an illustration of a new organizer handbag according to the present invention.

FIG. 2 is an illustration of the present invention open flat.

FIG. 3 is a detailed illustration of area 3 of FIG. 2.

DESCRIPTION OF THE PREFERRED EMBODIMENT

Figure 4:
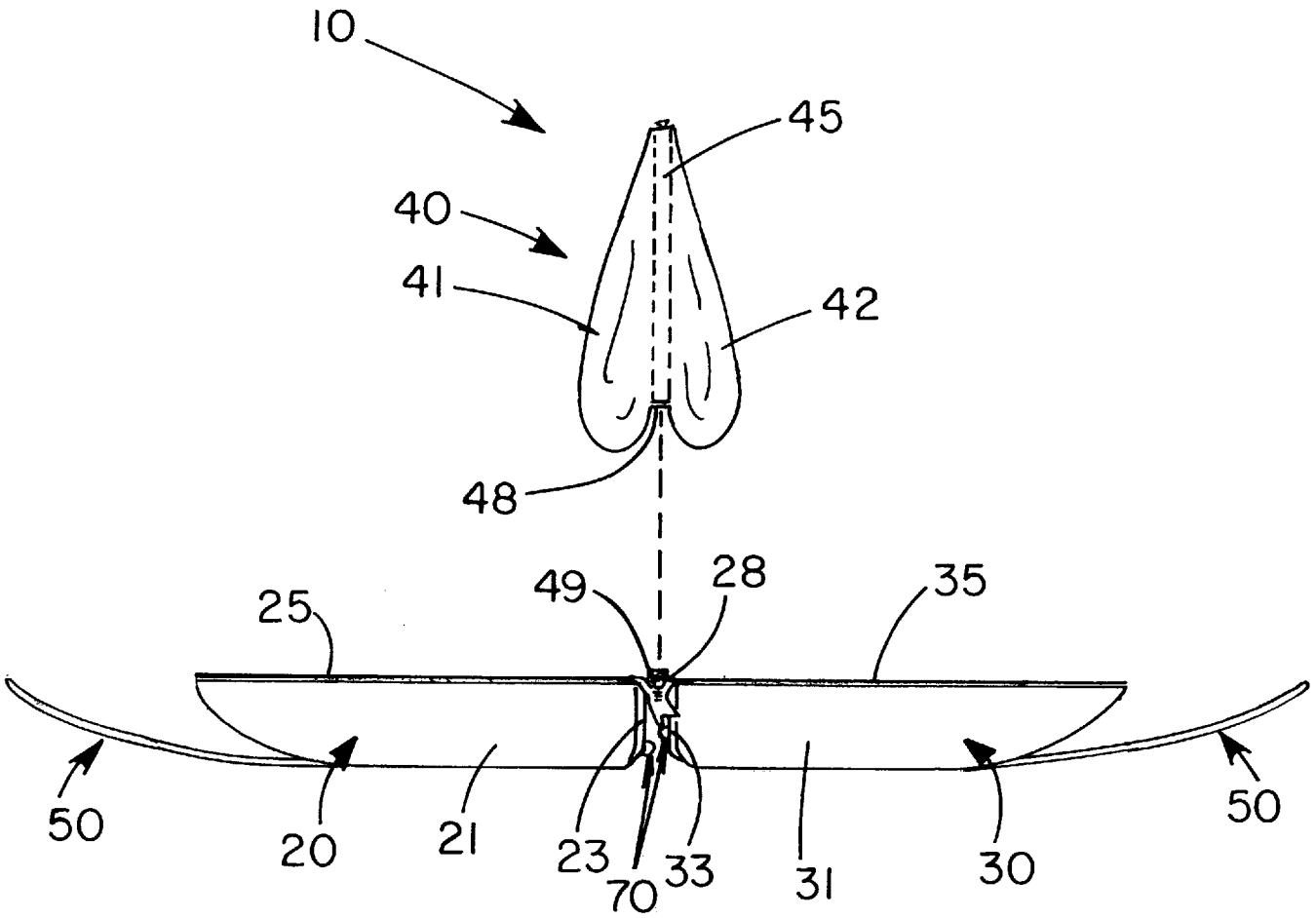
FIG. 4 is an illustration from the perspective of line 4—4 of FIG. 2 showing the removable inner pouch.

With reference now to the drawings, and in particular to FIGS. 1 through 5 thereof, a new organizer handbag embodying the principles and concepts of the present invention and generally designated by the reference numeral 10 will be described.

More specifically, it will be noted that the organizer handbag 10 comprises a first-half member 20 and a second-half member 30 hingedly coupled along adjacent bottom edges 24 and 34 and releasably joined along adjacent perimeter edges 25 and 35 so as to cooperatively define a primary storage compartment 12. The first-half member 20 and the second-half member 30 are cooperatively and hingedly openable between a closed, generally upright position and an open, generally flat position. A plurality of internal storage compartments 16 adapted for holding small items are provided on the inner surfaces 21*a* and 31*a* of the first-half member 20 and the second-half member 30 whereby quick and easy access to small items stored within the plurality of internal storage compartments 16 is possible. An inner pouch 40 is contained within the primary storage compartment 12 and is removable for convenient carrying thereof.

As best illustrated in FIGS. 1 through 5, it can be shown that the first-half member 20 and the second-half member 30 each include a side panel 21 and 31, a perimeter panel 22 and 32 contiguous with the side panel 21 and 31 on three sides thereof, and a bottom panel 23 and 33 contiguous with the side panel 21 and 31 and the perimeter panel 22 and 32. The side panel 21 and 31 has an inner surface 21*a* and 31*a* and an outer surface 21*b* and 31*b*. The first-half member 20 and the second-half member 30 each have a bottom edge 24 and 34 and a perimeter edge 25 and 35. The first-half member 20 and the second-half member 30 are hingedly coupled along adjacent bottom edges 24 and 34 and are releasably joined along adjacent perimeter edges 25 and 35 so as to cooperatively define a primary storage compartment 12. A hinge member 28 hingedly couples the first-half member 20 and the second-half member 30 along adjacent bottom edges 24 and 34 and a zipper closure 29 releasably joins the first-half member 20 and the second-half member 30 along adjacent perimeter edges 25 and 35.

Figure 5:
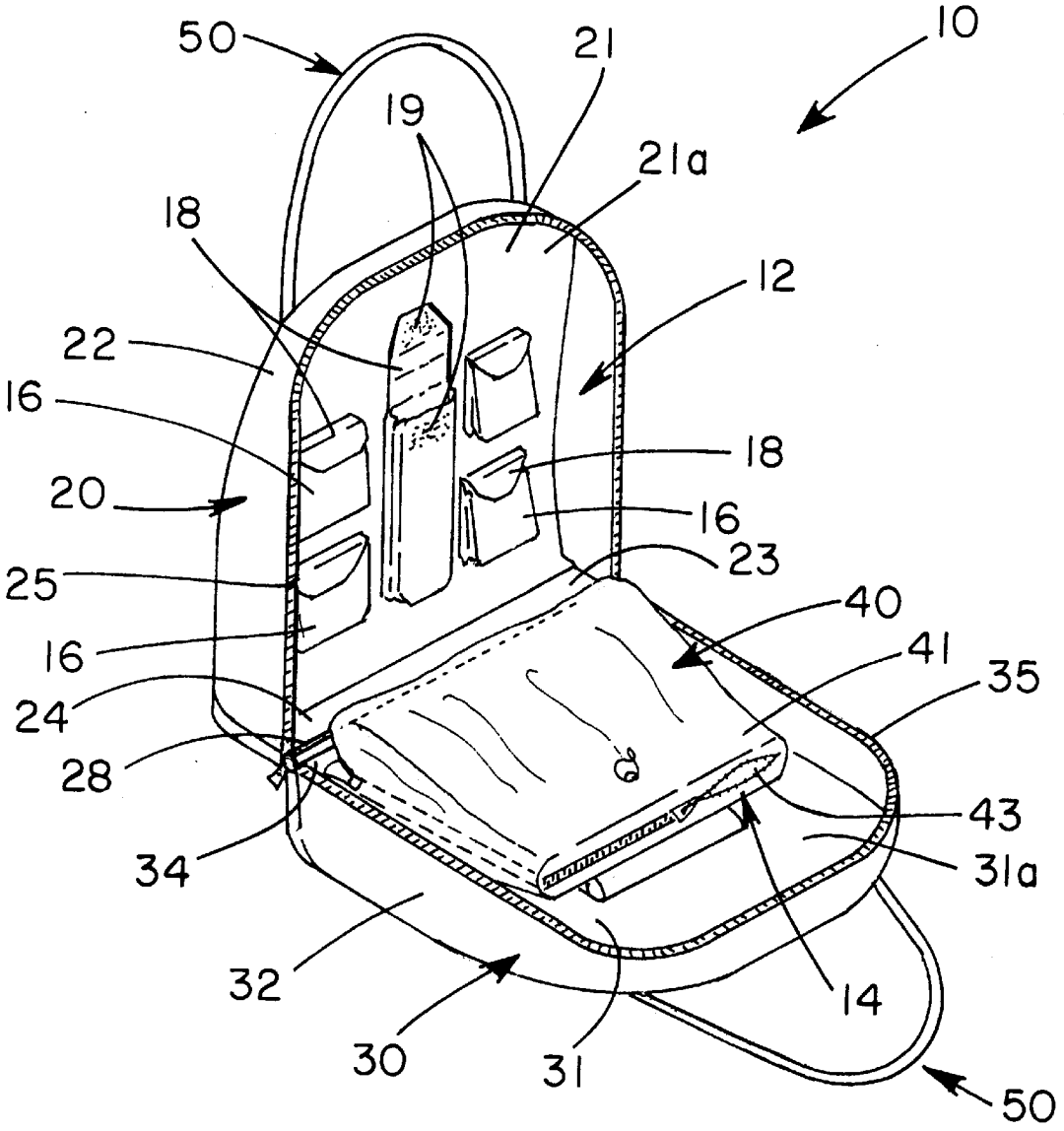
FIG. 5 is an illustration of the present invention in an open position.

As best illustrated in FIGS. 2 and 5, it can be shown that a plurality of internal storage compartments 16 are provided on the inner surface 21*a* of the side panel 21 of the first-half member 20 and on the inner surface 31*a* of the side panel 31 of the second-half member 30. The plurality of internal storage compartments 16 are of various shapes and sizes and each of the plurality of internal storage compartments 16 is adapted for holding a small item. A quantity of the plurality of internal storage compartments 16 are adapted and of a size tailored for holding a specific small item such as a lipstick container, a pair of finger nail clippers, a pen, a pencil, a pack of chewing gum, and others.

Each of the plurality of internal storage compartments 16 has at least one opening 17 therein. The opening 17 allows for insertion of a small item into one of the plurality of internal storage compartments 16. A quantity of the plurality of internal storage compartments include a closure flap 18. The closure flap 18 is provided adjacent the opening 17 and substantially closes the opening 17 in one of the plurality of internal storage compartments 16 so as to retain a small item placed therein. A hook and loop fastener 19 is provided for securely closing the closure flap 18. In one embodiment of the present invention, the plurality of internal storage compartments 16 are formed of a clear material so as to provide visual access to the small items stored therein.

As best illustrated in FIGS. 1 and 2, it can be shown that the first-half member 20 and the second-half member 30 are cooperatively and hingedly openable between a closed, generally upright position and an open, generally flat position. In the closed, generally upright position the perimeter edge 25 of the first-half member 20 and the perimeter edge 35 of the second-half member 30 are in abutting relation. In the open, generally flat position, the first-half member 20 and the second-half member 30 are each in a generally prone position wherein the outer surface 21*b* of the first-half member 20 and the outer surface 31*b* of the second-half member 30 are each facing downward. When the first-half member 20 and the second-half member 30 are in the open, generally flat position, visual and physical access to all the items stored within the primary storage compartment 12 and within the plurality of internal storage compartments 16 is provided whereby a user of the organizer handbag 10 may quickly and easily locate and retrieve items stored within the primary storage compartment 12 and in the plurality of internal storage compartments 16.

As best illustrated in FIGS. 2 through 5, it can be shown that an inner pouch 40 is contained within the primary storage compartment 12. The inner pouch 40 includes a front panel 41 and a back panel 42 cooperatively joined so as to form a secondary storage compartment 14 with a top opening 43. The inner pouch 40 is adapted for holding various items such as a wallet, a checkbook, a pair of eye glasses, and others.

A zipper closure 44 is provided for closing the top opening 43 of the inner pouch 40. The inner pouch 40 includes a pair of upright frame supports 45 each provided on an opposite end thereof. The pair of upright frame supports 45 are substantially rigid and support the inner pouch 40 in a generally upright orientation when the first-half member 20 and the second-half member 30 are in the open, generally flat position.

The inner pouch 40 is releasably attached to the hinge member 28 and as such, is removably detained within the primary storage compartment 12. A hook and loop fastener is provided for releasably attaching the inner pouch 40 to the hinge member 28, and illustratively a hook portion 48 of the hook and loop fastener 47 is provided on an underside of the inner pouch 40 and a mating loop portion 49 of the hook and loop fastener 47 is provided on the hinge member 28.

As best illustrated in FIGS. 1 and 2, it can be shown that a pair of top handles 50 are provided for carrying the organizer handbag 10. A first of the pair of top handles 50 is attached to the side panel 21 of the first-half member 20 and a second of the pair of top handles 50 is attached to the side panel 31 of the second-half member 30. An adjustable shoulder strap 60 is provided so that a user of the organizer handbag 10 may carry the organizer handbag 10 from their shoulder. The adjustable shoulder strap 60 is removably attached to the first-half member 20 and the second-half member 30.

A pair of feet 70 are provided on an outer surface of the bottom panel 23 of the first-half member 20 and on an outer surface of the bottom panel 33 of the second-half member 30. The pair of feet 70 protect the bottom panel 23 of the first-half member 20 and the bottom panel 33 of the second-half member 30 from contacting an underlying surface.

In use, the organizer handbag 10 is carried by use of the pair of top handles 50 or the adjustable shoulder strap 60. To gain access to the primary storage compartment 12, the zipper closure 29 is unzipped thereby allowing the first-half member 20 and the second-half member 30 to open along the adjacent perimeter edges 25 and 35 thereof. The first-half member 20 and the second-half member 30 are opened to the open, generally flat position whereby visual and physical access to all the items stored within the primary storage compartment 12 and stored within the plurality of internal storage compartments 16 is provided. As such, a user of the organizer handbag 10 may quickly and easily locate and retrieve items stored within the primary storage compartment 12 and stored within the plurality of internal storage compartments 16.

A user may place an item in one of the plurality of internal storage compartments 16 by inserting the item through the opening 17 provided therein and may retain the item in the internal storage compartment 16 by using the closure flap 18. A user may also remove an item from or place an item in the inner pouch 40 through the top opening 43 therein. The inner pouch 40 may be removed from within the primary storage compartment 12 for convenient carrying thereof. When a user of the organizer handbag 10 has finished removing an item from or placing an item in the primary storage compartment 12, one of the plurality of internal storage compartments 16, or the inner pouch 40, the zipper closure 29 is zipped up and the adjacent perimeter edges 25 and 35 of the first-half member 20 and the second-half member 30 are releasably joined.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. An organizer handbag comprising:

a first-half member, said first-half member including a side panel having an inner surface and an outer surface, said first-half member having a bottom edge and a perimeter edge;

a second-half member, said second-half member including a side panel having an inner surface and an outer surface, said second-half member having a bottom edge and a perimeter edge, said first-half member and said second-half member being pivotally coupled together at a spine along said bottom edge of said first-half member and said bottom edge of said second-half member, joining means on said perimeter edge of said first-half member and said perimeter edge of said second-half member for releasably joining the perimeter edges of said first-half and second-half members so as to cooperatively define a primary storage compartment therebetween, said first-half member and said second-half member being cooperatively hingedly openable between a closed, generally upright position and an open, generally flat position; and a plurality of internal storage compartments provided on said inner surface of said side panel of said first-half member and on said inner surface of said side panel of said second-half member;

an inner pouch being removably mountable on said first-half and said second-half members so as to be containable in said primary storage compartment when said first-half and said second-half members are in a closed position said inner pouch having a support frame comprising an elongate central portion with opposite ends and an upright portion at each end of the central portion, said support frame being substantially rigid for supporting said inner pouch in an upright position, mounting means for removably mounting said inner pouch to the interior of said primary storage compartment, said mounting means being comprised of two components attachable to and detachable from each other, said first component being located on the spine coupling said first-half and second-half members and said second component being located on said inner pouch adjacent the central portion of the support frame thereof, wherein connection of said first and second components of said mounting means together mounts said inner pouch in a substantially upright orientation in said primary storage compartment when said first-half and second-half members are pivoted into an open, generally flat position wherein said inner pouch includes a front panel formed from material mounted on said support frame, a back panel formed from material mounted on said frame, said front panel and said back panel being cooperatively joined so as to form a secondary storage compartment with a top opening, and a closure for closing said top opening wherein the front panel and the back panel of said inner pouch are adapted to drape on opposite sides of said spine when said support frame of said inner pouch is rested on said spine.

2. The organizer handbag of claim 1 wherein said plurality of internal storage compartments are formed of a clear material so as to provide visual access to said item inserted therein.

3. The organizer handbag of claim 1 further comprising:

a pair of top handles, a first of said pair of top handles attached to said side panel of said first-half member and a second of said pair of top handles attached to said side panel of said second-half member.

4. The organizer handbag of claim 1 further comprising:

a shoulder strap attached to said first-half member and said second-half member.

5. An organizer handbag comprising:

a first-half member, said first-half member including a side panel having an inner surface and an outer surface, said first-half member having a bottom edge and a perimeter edge;

a second-half member, said second-half member including a side panel having an inner surface and an outer surface, said second-half member having a bottom edge and a perimeter edge, said first-half member and said second-half member being pivotally coupled together at a spine along said bottom edge of said first-half member and said bottom edge of said second-half member, joining means on said perimeter edge of said first-half member and said perimeter edge of said second-half member for releasably joining the perimeter edges of said first-half and second-half members so as to cooperatively define a primary storage compartment therebetween, said first-half member and said second-half member being cooperatively, hingedly openable between a closed, generally upright position and an open, generally flat position;

a pair of top handles, a first of said pair of top handles attached to said side panel of said first-half member and a second of said pair of top handles attached to said side panel of said second-half member, and a shoulder strap attached to said first-half member and said second-half member;

a plurality of internal storage compartments provided on said inner surface of said side panel of said first-half member and on said inner surface of said side panel of said second-half member;

an inner pouch being removably mountable on said first-half and said second-half members so as to be containable in said primary storage compartment when said first-half and said second-half members are in a closed position, said inner pouch having a support frame comprising an elongate central portion with opposite ends and an upright portion at each end of the central portion, said support frame being substantially rigid for supporting said inner pouch in an upright position, mounting means for removably mounting said inner pouch to the interior of said primary storage compartment, said mounting means being comprised of two components attachable to and detachable from each other, said first component being located on the spine coupling said first-half and second-half members and said second component being located on said inner pouch adjacent the central portion of the support frame thereof, wherein connection of said first and second components of said mounting means together mounts said inner pouch in a substantially upright orientation in said primary storage compartment when said first-half and second-half members are pivoted into an open, generally flat position, wherein said mounting means comprises hook and loop fastener means, one of said components of said hook and loop fastener means comprising a hook fastener portion and the other of said components comprising a loop fastener portion;

wherein in said open, generally flat position, said first-half member and said second-half member are each in a generally prone position whereby said outer surface of said side panel of said first-half member and said outer surface of said side panel of said second-half member are each facing downward, whereby visual and physical access is provided to each of said primary storage compartment and said plurality of internal storage compartments;

wherein each of said plurality of internal storage compartments has at least one opening therein, said opening allowing for insertion of an item into one of said plurality of internal storage compartments, a quantity of said plurality of internal storage compartments including a closure flap, said closure flap provided adjacent said opening and substantially closing said opening, said plurality of internal storage compartments being formed of a clear material so as to provide visual access to said item inserted therein;

wherein said inner pouch comprises:

a front panel formed from material mounted to the support frame, a back panel formed from material mounted to the support frame, said front panel and said back panel being cooperatively joined so as to form a secondary storage compartment with a top opening, and a closure for closing said top opening; and wherein the front panel and the back panel of said inner pouch are adapted to drape on opposite sides of said spine when said support frame of said inner pouch is rested on said spine.

* * * * *